US006202735B1

(12) United States Patent
Rittner

(10) Patent No.: US 6,202,735 B1
(45) Date of Patent: Mar. 20, 2001

(54) TUNDISH CARRIAGE

(75) Inventor: Karl Rittner, Hilden (DE)

(73) Assignee: SMS Schloemann-Siemag AG, Dusseldorf (DE)

( * ) Notice: Subject to any disclaimer, the term of this patent is extended or adjusted under 35 U.S.C. 154(b) by 0 days.

(21) Appl. No.: 09/262,383

(22) Filed: Mar. 4, 1999

(30) Foreign Application Priority Data

Mar. 5, 1998 (DE) ..... 198 09 446

(51) Int. Cl.[7] ..... B22D 11/10
(52) U.S. Cl. ..... 164/437; 164/438; 164/439
(58) Field of Search ..... 164/437, 438, 164/439, 488, 489; 266/165

(56) References Cited

U.S. PATENT DOCUMENTS 4,678,167 * 7/1987 Lemper ..... 266/165

FOREIGN PATENT DOCUMENTS 23 06 095 8/1974 (DE) .
25 06 766 8/1975 (DE) .
25 57 769 6/1977 (DE) .
61-007053 1/1986 (JP) .
61-119358 6/1986 (JP) .

OTHER PUBLICATIONS

JP 61 007053 A (Sumitomo Jukikai Kogyo K.K.) Jan. 13, 1986, vol. 010, No. 153 (M–484), Jun. 3, 1986.
JP 61 119358 A (Nippon Steel Corp.) Jun. 6, 1986, vol. 010, No. 307 (M–527), Oct. 18, 1986.

* cited by examiner

*Primary Examiner*—Harold Pyon
*Assistant Examiner*—I.-H. Lin
(74) *Attorney, Agent, or Firm*—Herbert Dubno

(57) ABSTRACT

A tundish carriage for a double-strand continuous caster has a carriage frame displaceable on rails straddling a pair of parallel-wall or funnel-shaped continuous casting billet molds. The frame is of trapezoidal configuration with one relatively long beam and one relatively short beam connected by transverse beams at vertices provided with bolsters riding on the rails and with units for raising and lowering the trough for receiving the molten metal. The casting tubes extend downwardly from the trough and can be individually aligned with the respective molds without affecting the position of the other casting tube, utilizing an adjusting device at each bolster connecting a transverse beam with the longer of the longitudinal beams.

6 Claims, 4 Drawing Sheets

TUNDISH CARRIAGE

FIELD OF THE INVENTION

My present invention relates to a tundish carriage and, more particularly, to a distributor for feeding molten metal into a double-strand continuous machine wherein that distributor is mounted on a pair of parallel rails and has a trough communicating with casting tubes opening into the respective continuous casting molds.

BACKGROUND OF THE INVENTION

A tundish carriage for a double-strand continuous caster can have a pair of parallel rails upon which a frame is mounted which receives a trough having casting tubes adapted to communicate with respective continuous casting molds and which can be raised and lowered and can be displaced transversely to the casting direction. The casting molds can be comparatively small parallel-wall or conical-wall molds and the frame is usually comprised of two longitudinal beams and transverse beams connecting the longitudinal beams. The vertices of the substantially rectangular frame are formed with bolsters, each of which can have a wheel riding on a respective rail and a lifter for raising and lowering the trough and provided with an attachment point or support point for the trough on the frame.

In conventional tundish carriages of this type, the trough itself is supported at the bolsters and hence at each of the vertices of the generally rectangular frame symmetrically with respect to the longitudinal axis or a longitudinal median plane through the trough and the frame. The positioning of the casting tubes in molds for the continuous casting of billets must be relatively exact since there is little space to allow for variability in the locating of the casting tubes in such small molds. Hence significant relative movement of the casting tube and the thin-billet parallel-wall or conical-wall molds cannot be tolerated primarily because of the relatively small size of such molds. This will be understood when it is recognized that the spacing of the broad-side copper plates of such molds from one another is for example about 35 mm. As a consequence utilizing the conventional tundish carriage with a rectangular frame and the casting tubes rigidly fixed with respect to one another and the casting frame and other parts of the carriage, significant relative movement could not be provided for a centering process of each casting tube with respect to its mold.

The tundish between the ladle and the casting mold, however, plays a very important role with respect to the quality of the product made. The quality of the continuously cast steel can deteriorate rapidly if undesired elements, like oxygen and nitrogen, are incorporated in the molten metal and hence the uncontrolled incorporation of such elements must be avoided as much as possible. The size and shape of the trough must be chosen so that advantageous rheological conditions are maintained to thereby prevent the entrainment of impurities or to exclude impurities which may be present in the melt from flowing into the mold. Furthermore, from a structural point of view it is important that the tundish be capable of withstanding the stresses of crane transport and melt loading with a minimum of elastic deformation so that there is little if any damage to refractory materials. Finally, residual shape changes resulting from thermal loads, for example, preheating, are not permissible.

Tundishes for two-strand casters have undergone a significant development over the years and while only about ten years ago the average capacity of such a tundish was 15 to 20 tons, today the tundish is required to have a capacity of some 50 to 70 tons. Indeed, while in the past the depth of the molten metal in the tundish was limited to 0.6 to 0.8 meters, currently depths in excess of one meter and lately as much as 1.3 meters are used. As a result, the residence time of the steel melt in the tundish has increased and the flow velocities of the melt have been reduced so that the separation out of impurities at the covering powder is greatly improved.

Tundishes for double-strand molds are generally satisfactory in these latter respects as they are presently constructed. Slider valves or stopper devices have been used to control the outflow from tundishes into continuous casting molds and it has been found that slider valves have a drawback in that air can be sucked into the molten stream through the slider gap. Hence the steel melt admitted through a slide valve may have a greater degree of contamination than a steel melt passing through a casting tube provided with a stopper arrangement.

Japanese open application 61-119358 (application 59-238244) describes a tundish trough for a two-strand continuous caster for producing billet strands. The relatively wide tundish trough is subdivided transversely to the longitudinal direction into two trough parts by a longitudinal partition. One of these parts serves to receive the steel melt from the ladle while the other feeds the casting tubes which are aligned with the two continuous casting molds. The partition is provided close to its bottom with a throughgoing opening that communicates between the two compartments separated by the partition and which thus allows the melt to flow from the receiving compartment to the discharge compartment. Impurities are held back by the partition in the receiving compartment and the product quality is enhanced.

Another problem with respect to earlier tundish arrangements for continuous casting is the difficulty of ascertaining the exact position of the casting or pouring tube with respect to the mold. In most instances the positioning of the pouring tube with respect to the molds could not be visually observed, or if visually observable was at least partly obscured by the tundish carriage structure.

OBJECTS OF THE INVENTION

It is the principal object of the present invention to provide an improved tundish carriage for a double-strand caster whereby disadvantages and drawbacks of prior constructions are avoided and continuous casting can be carried out in relatively narrow billet molds, especially parallel-wall or funnel-shaped thin billet molds, with higher quality.

Another object of the invention is to provide an improved tundish carriage for a double-strand continuous casting machine which allows more precise alignment of the casting tubes with the respective molds than has been possible heretofore.

Still another object of the invention is to provide a tundish carriage which improves the visibility of the positioning of the casting tubes with respect to the molds so that positioning of the casting tubes can be carried out with greater precision.

SUMMARY OF THE INVENTION

These objects and others which will become apparent hereinafter are attained, in accordance with the invention, by forming the frame as a trapezoid with one of the longitudinal beams being significantly longer than the other so that the frame is asymmetrical with respect to the longitudinal axis of the trough and by providing the bolsters along the longer beam with adjustment drives capable of aligning one of the casting tubes in its mold without variation of the position of the casting tube of the mold for the other strand or vice versa.

More particularly, a tundish carriage for a double-strand continuous caster having a pair of parallel rails straddling at least two continuous casting molds comprises:

a carriage frame having longitudinal beams extending in a direction of displacement of the carriage along the rails and of different lengths, the longitudinal beams being asymmetrical with respect to a longitudinal axis of the carriage, and transverse beams interconnecting ends of the longitudinal beams at respective vertices to form generally a trapezoid with the longitudinal beams;

respective bolsters at the vertices supporting the frame movably on the rails;

a distributor trough on the frame for receiving molten metal and having a pair of casting tubes each adapted to register with one of the molds; and adjustment drives on the bolsters at the longer of the longitudinal beams for aligning one of the casting tubes in a respective one of the molds for one of the strands without altering a position of the other casting tube in the other mold for the other of the strands and vice versa.

The asymmetrical configuration of the frame, wherein the transverse beams are inclined to the longitudinal beams ensures visibility of the casting tubes and their alignment with the respective continuous casting molds and the adjustability at the bolsters transverse to the direction of displacement (and transversely to the longer longitudinal beam) allows adjustment of the position of one casting tube transversely to the longitudinal beams without alteration of the position of the other.

It has been found to be advantageous to provide the angle between each transverse beam and the longitudinal beam between 30 and 60°, preferably around 45°.

Furthermore, the distributor trough can be provided with an overflow which can open into a deflector trough, preferably substantially at the center of the distributor trough.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
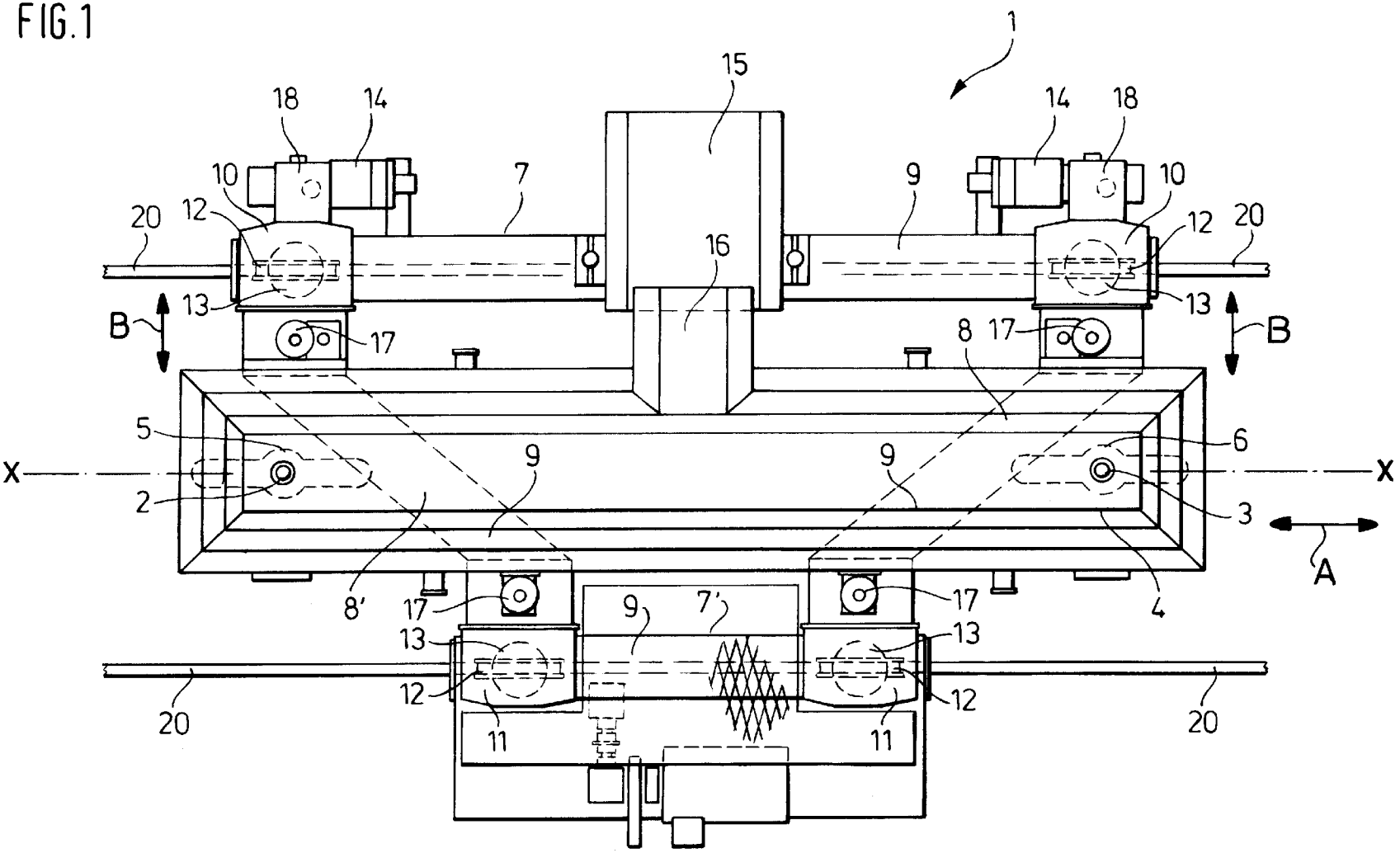
FIG. 1 is a plan view of a tundish carriage system according to the invention with the distributor trough in place on the carriage.
Figure 3:
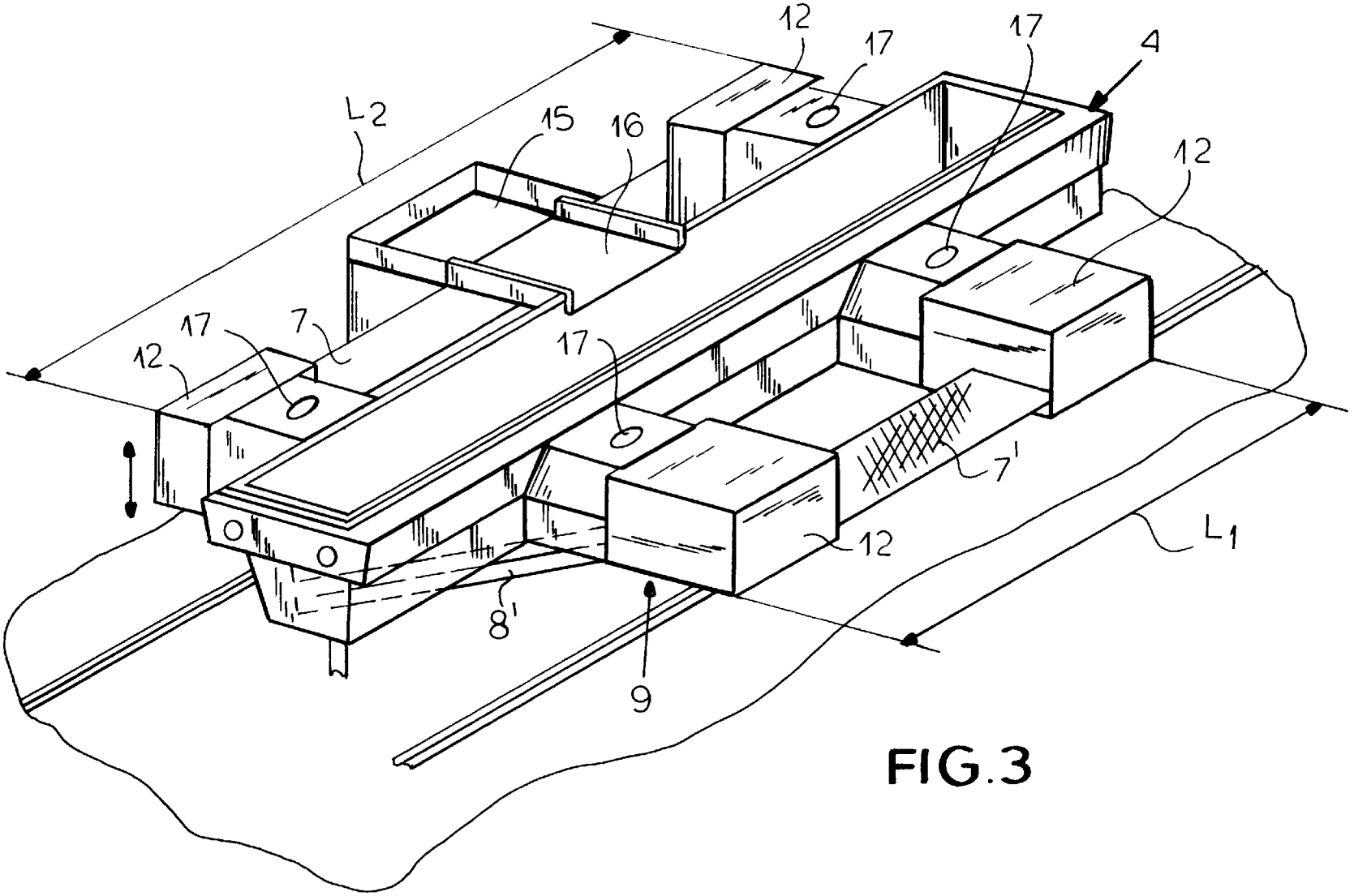
FIG. 3 is a highly diagrammatic perspective view similar to FIG. 2 but of the system of the invention with its trapezoidal frame.

The system shown in FIGS. 1 and 3, forming a tundish carriage for a double-strand continuous casting machine, comprises a tundish carriage 1 displaceable on a pair of rails 2 in a direction of displacement represented by the double-headed arrow A which is parallel to the longitudinal median plane perpendicular to the paper through the axis X—X of the apparatus. The displacement can be between a heating position in which the trough of the tundish carriage is preheated, e.g. by torches, and a casting position in which the tundish discharges into the molds.

During the displacement in the longitudinal direction, the distributor trough 4 of the tundish carriage is lifted into its raised position so that the casting tubes 2 and 3 can clear the respective molds 5 and 6. In other words, before the longitudinal displacement the trough 4 is lifted sufficiently high that the casting tubes 2, 3 are withdrawn from the molds and can travel without colliding with the molds. When in place for casting, the trough 4 is lowered so that the casting tubes 2 and 3 are disposed with relative precision within the parallel-wall or funnel-shaped narrow molds 5 and 6.

It is important that the casting tubes be positioned with precision in these molds because of the relatively small distance between the broad walls of the molds. In the drawing, the funnel-shaped molds 5 and 6 can be understood to represent also parallel wall molds. The trough 4 is formed centrally with an emergency overflow channel 16 opening into a diverter trough 15.

As can be seen further from FIGS. 1 and 3, the tundish carriage 1 has a frame 9 constituted from two longitudinal beams 7, 7' and transverse beams 8, 8' interconnecting the longitudinal beams and defining corners or vertices therewith, at each of which a bolster 10 or 11 is provided. The bolsters 10 and 11 each have swivelable wheels 12 riding on the respective rail 20 and a lifting arrangement 13 serving to raise and lower the distributor trough 4 which rests upon support points 17 formed by the lifting units 13 on the frame 9.

According to the invention, the frame 9 has longitudinal beams 7, 7' of different lengths and is of trapezoidal configuration, i.e. is asymmetrical relative to the longitudinal axis X—X.

The bolsters 10 at the longer beam 7 have adjustment drives 14 with driven members 18 which can serve to displace the respective end of the frame 9 in directions represented by the arrows D so that one of the casting tubes 2 or 3 can be precisely aligned in the respective mold 5 or 6 without displacing the other casting tube to any significant extent. The alignment of one casting tube without displacing the other and vice versa is thus possible.

Figure 4:
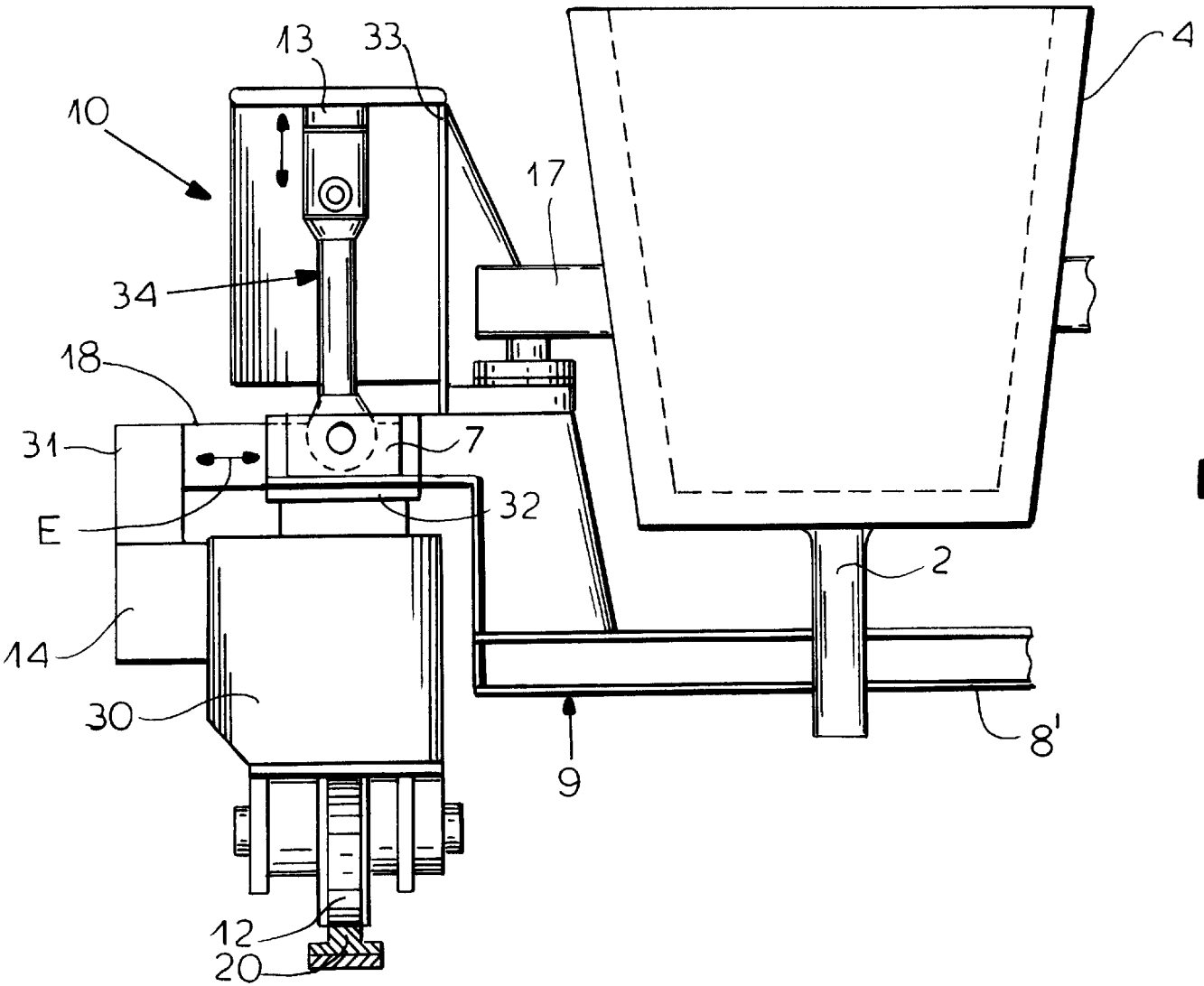
FIG. 4 is a diagrammatic cross section of one of the bolsters at the longer beam.

As can be seen from FIG. 4, the frame 9 is a rigid structure, i.e. a structure wherein the longer beams 7, 7' are welded to a rigid structure with the transverse beams 8 and 8', and that rigid structure can be mounted upon a roller carriage 30 at each of the bolsters, the carriage being provided with the respective wheel 12 riding on the respective rail 20. The motor unit 14 of each adjustment drive can be connected to the carriage 30 while the driven member 18 thereof can be shifted in the direction of the arrow E by the stepped-down gearing and cam or cam unit 31 of the adjustment drive. The frame 9, for that purpose, is shown to lie on the pillow 32 of the carriage 30 and the cylinder unit 13 forming the lifting arrangement may be braced between a bracket 33 carried by the frame 9 and the longer beam 7 via a swivel arm arrangement represented diagrammatically at 34. The bracket 33 is provided with the support point 17 for the trough 4.

The adjusting system 14, 18, etc. thus allows one of the tubes 2 to be shifted relative to the mold 5 while the tube 3 remains stationary and vice versa by appropriate shifting of the respective end of the frame 9 by the adjustment drives.

As FIG. 1 also shows, the angles between the transverse beams 8 and 8' can be between 30° and 60° with the longitudinal beams 7, 7' and preferably is about 45°. As a consequence, the positioning of each casting tube 2, 3 is readily visible at the end of the trough 4.

Figure 2:
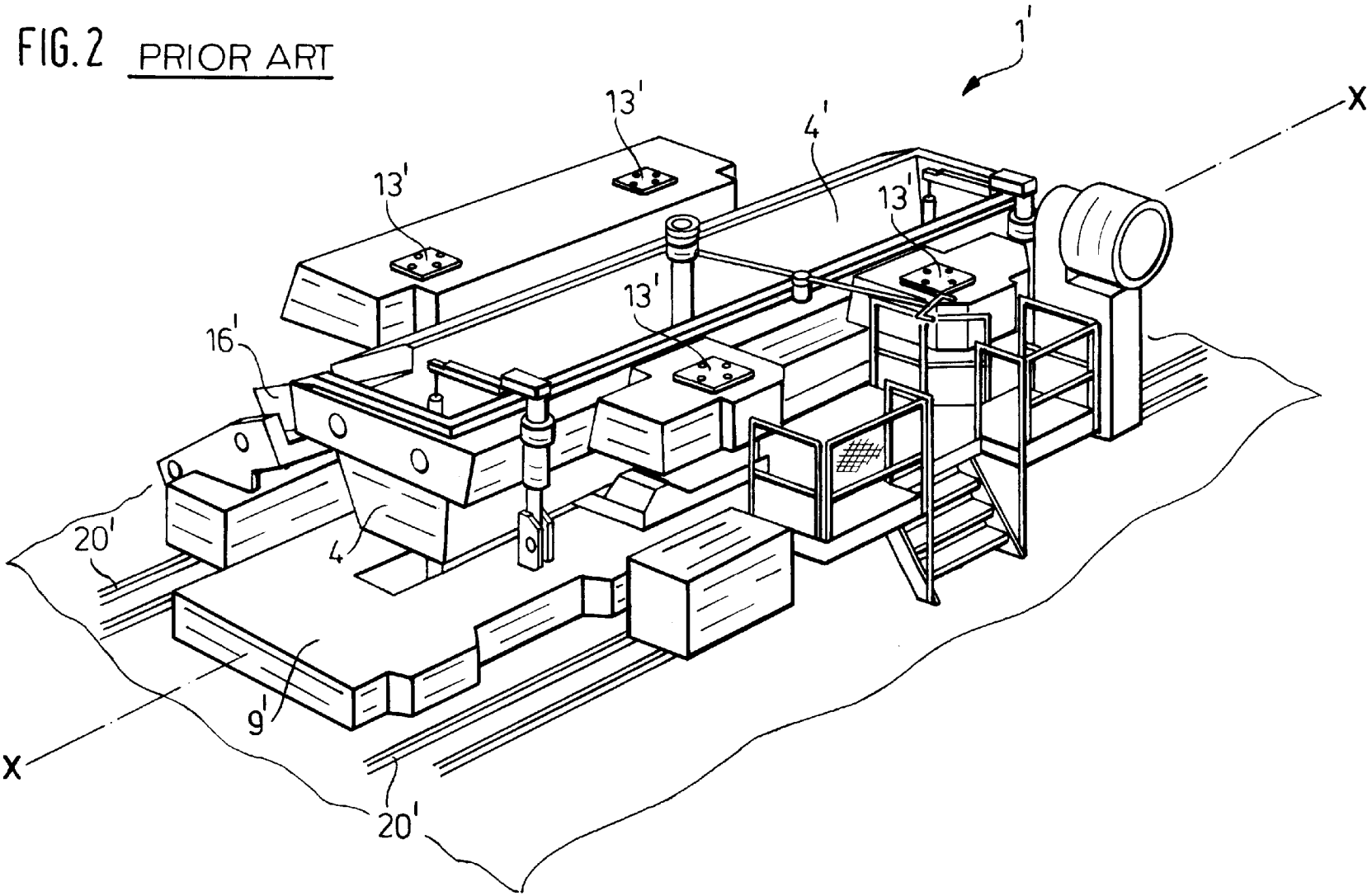
FIG. 2 PRIOR ART
FIG. 2 is a perspective view of a prior art arrangement of a tundish carriage with its distributor trough.

By contrast, in a conventional tundish carriage of the type shown in FIG. 2, the frame 9' is substantially rectangular and it is practically impossible to see the alignment of the casting tube with the respective mold. In this prior art arrangement as well, the distributor trough 4' is supported on four lifting units 13' on the frame 9' to form the tundish carriage 1' and the entire carriage is displaceable on the doubled rails 20' on each side of the molds.

It will be apparent that, with this construction, alignment of the casting tubes relative to the openings in the molds is not possible and either a certain lack of alignment must be accepted, or the system can be used only for molds of relatively wide spacing between the broad surfaces so that sufficient free space is available to compensate for the greater position tolerances.

With the system of the invention as shown in FIGS. 1 and 3, exact alignment of a casting tube with a mold opening is possible so that smaller positional tolerances can be accommodated and hence the system can be used with high effectiveness for parallel or funnel-shaped molds for thinner billets.

The tundish carriage of the invention (FIGS. 1 and 3) is operated like tundish carriages for existing double-strand molds, i.e. prior to pouring of the molten metal from the ladle into trough 4, the latter is preheated at a preheating station and then shifted on the rails 4 to the casting position, whereupon the trough 4 is lowered so that the casting tubes 2 and 3 are introduced into the upwardly open tops of the casting molds. The casting tubes can then be accurately aligned via the adjusting devices 14, 18, each without affecting the position of the other casting tube and the molten metal can be poured into the trough 4, covered with the usual powder and the flow can be controlled, e.g. by stoppers or the like. The stoppers can be mounted on the trough itself, rather than on the frame as has been shown for the prior art system of FIG. 2.

I claim:

1. A tundish carriage for a double-strand continuous caster having a pair of parallel rails straddling at least two continuous casting molds, said tundish carriage comprising:

a carriage frame having longitudinal beams extending in a direction of displacement of said carriage along said rails and of different lengths, said longitudinal beams being asymmetrical with respect to a longitudinal axis of said carriage, and transverse beams interconnecting ends of said longitudinal beams at respective vertices to form a trapezoid with said longitudinal beams, wherein said transverse beams intersect angles of 30° to 60° with the longer of the longitudinal beams;

respective bolsters at said vertices supporting said frame movably on said rails;

a distributor trough on said frame for receiving molten metal and having a pair of casting tubes each arranged to register with one of said molds; and adjustment drives on the bolsters at the longer of said longitudinal beams for aligning one of said casting tubes in a respective one of said molds for one of said strands without altering a position of the other casting tube in the other mold for the other of said strands and vice versa.

2. The tundish carriage defined in claim 1 wherein said transverse beams include an angle of 45° with the longitudinal beams.

3. The tundish carriage defined in claim 2 wherein the trough has an overflow channel connected to a deflector.

4. The tundish carriage defined in claim 3 wherein the overflow channel is located substantially midway of the length of said trough.

5. The tundish carriage defined in claim 1 wherein the trough has an overflow channel connected to a deflector.

6. The tundish carriage defined in claim 5 wherein the overflow channel is located substantially midway of the length of said trough.

* * * * *